US008272229B2

(12) United States Patent
Choi et al.

(10) Patent No.: US 8,272,229 B2
(45) Date of Patent: Sep. 25, 2012

(54) AIR CONDITIONER AND CONTROL BOX ASSEMBLY

(75) Inventors: Jei Min Choi, Suwon-si (KR); Jai Kwon Lee, Suwon-si (KR); Do Yeon Kim, Anyang-si (KR); Dae Sung Lee, Suwon-si (KR); Jong Ki Jeon, Suwon-si (KR); Jong Won Lee, Seongnam-si (KR); Kang Min Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 856 days.

(21) Appl. No.: 12/320,364

(22) Filed: Jan. 23, 2009

(65) Prior Publication Data

US 2009/0205352 A1 Aug. 20, 2009

(30) Foreign Application Priority Data

Feb. 20, 2008 (KR) ..... 10-2008-0015420

(51) Int. Cl.
*F25D 23/12* (2006.01)

(52) U.S. Cl. ..... 62/259.1

(58) Field of Classification Search ..... 62/259.1, 62/426, 498

See application file for complete search history.

(56) References Cited

FOREIGN PATENT DOCUMENTS

KR 10-2003-0055048 7/2003

*Primary Examiner* — Melvin Jones
(74) *Attorney, Agent, or Firm* — Staas & Halsey LLP

(57) ABSTRACT

Disclosed is an air conditioner having a control box assembly, which enhances the serviceability of a circuit board and reduces production costs. In the air conditioner, which has a casing unit forming an external appearance of the air conditioner, a heat exchanger, a blowing device, and a control box assembly provided in the casing, the control box assembly includes a mounting unit mounting a circuit board; a control box housing the circuit board and the mounting unit; and guide units provided in the control box to guide a rectilinear reciprocating motion of the mounting unit to allow the mounting unit to come into and out of the control box and guide a rotating motion of the mounting unit in the case that the mounting unit is located at a designated position.

14 Claims, 7 Drawing Sheets

AIR CONDITIONER AND CONTROL BOX ASSEMBLY

CROSS-REFERENCE TO RELATED APPLICATIONS

This application claims the benefit of Korean Patent Application No. 2008-0015420, filed Feb. 20, 2008, in the Korean Intellectual Property Office, the disclosure of which is incorporated herein by reference.

BACKGROUND

1. Field

The present invention relates to an air conditioner, and more particularly, to an air conditioner having a control box assembly disposed to efficiently use an inside of a main body thereof.

2. Description of the Related Art

In general, air conditioners are apparatuses that regulate temperature, etc., to be suitable for human living using a refrigerating cycle. The refrigerating cycle is composed of a compressor, a condenser, an evaporator, a blower fan, etc.

An air conditioner includes a casing forming an external appearance of the air conditioner and having air suction holes and air discharge holes, a heat exchanger, a blowing device to forcibly blow air such that the air passed through the heat exchanger is discharged to a conditioning space, and a control box assembly having components to control the air conditioner.

The control box assembly of the conventional air conditioner includes a control box fixedly installed in the casing, a PCB fixed to the inside of the control box, and a cover closing the control box, and respective components of the air conditioner are electrically connected on the PCB.

If the PCB malfunctions, after the control box is separated from the casing and then the cover is separated from the control box, the PCB is repaired or replaced with a new one and thus the workability is lowered.

In order to solve the above problem, Korean Patent Laid-open Publication No. 2003-0055048 discloses an air conditioner, in which an attachment unit is installed in a display hole and serves to mount or separate a display unit and a PCB installed in a control box into or out of the air conditioner through the display hole such that the display panel and the PCB can be detachably attached to the air conditioner in a one touch method. Thereby, when the PCB malfunctions, the PCB can be repaired or replaced without separating a front panel from the air conditioner and thus time and cost to repair or replace the PCB can be reduced.

However, the conventional air conditioner disclosed in the above Publication, has a complicated structure of the attachment unit of the PCB and a complicated structure of a fixing unit to connect a main body of the attachment unit and a holder, thus increasing production costs.

SUMMARY

Therefore, one aspect of the embodiment is to provide an air conditioner having a control box assembly, which enhances the serviceability of a circuit board and reduces production costs concurrently.

Additional aspects and/or advantages will be set forth in part in the description which follows and, in part, will be apparent from the description, or may be learned by practice of the invention.

The foregoing and/or other aspects are achieved by providing an air conditioner, including a casing unit forming an external appearance of the air conditioner; a heat exchanger; a blowing device; and a control box assembly provided in the casing unit including a mounting unit mounting a circuit board, a control box housing the circuit board and the mounting unit, and guide units provided in the control box to guide a rectilinear reciprocating motion of the mounting unit to allow the mounting unit to come into and out of the control box and guide a rotating motion of the mounting unit when the mounting unit is located at a designated position.

Each of the guide units may include a first guide slot guiding the rectilinear reciprocating motion of the mounting unit, and a second guide slot inclined from the first guide slot at a designated angle guiding the rotating motion of the mounting unit.

Each of the guide units may include a fixing part fixing the mounting unit when the mounting unit is inserted into the control box.

The casing unit may include a front casing and a rear casing, a rear surface of the mounting unit being supported by a front end of the rear casing when the mounting unit is rotated.

The mounting unit may be disposed to slide perpendicularly to a rear surface of the casing unit and may be rotated in an outward direction of the casing unit when the mounting unit is located at a designated position protruding from the control box.

One side of the circuit board may be connected to the mounting unit by insertion and another side of the circuit board may be fixed to the mounting unit by screw connection.

The foregoing and/or other aspects are achieved by providing an air conditioner, including a control box assembly, the control box assembly including a mounting unit mounting a circuit board, and guide units supporting the mounting unit and guiding a sliding motion and a rotating motion of the mounting unit.

The foregoing and/or other aspects are achieved by providing an air conditioner, including a casing unit forming an external appearance of the air conditioner and housing various components; a circuit board to control the various components; a mounting unit mounting a circuit board; and guide units provided in the casing unit guiding a motion of the mounting unit when the mounting unit is connected to the casing unit, the mounting unit rectilinearly reciprocating against the guide units and being rotated to expose the circuit board in an outward direction of the casing unit when the mounting unit is located at a designated position.

The foregoing and/or other aspects are achieved by providing a control box assembly for an air conditioner having a circuit board, the control box assembly including: a control box to receive the circuit board; a mounting unit mounting the circuit board and being received within the control box; and guide units affixed within the control box and receiving the mounting unit, the mounting unit being rectilinearly reciprocated along the guide units when the mounting unit is removed from within the control box and being rotated with respect to the direction of the rectilinear reciprocating motion.

The mounting unit may be rotated to a position substantially perpendicular to a position at which the mounting unit is removed from the control box.

The mounting unit may include a plurality of guide protrusions.

The guide units may each include a first guide slot along a length of the guide unit and a second guide slot substantially at an end of the guide unit, the first guide slot receiving the guide protrusions, the second guide slot capable of receiving at least one of the guide protrusions.

The second guide slot may be substantially perpendicular with respect to the first guide slot.

The control box assembly may further include a fixing unit disposed at an end of the first guide slot opposite the second guide slot, the fixing unit receiving at least one of the guide protrusions to fix the mounting unit to the control box.

The control box assembly may be provided within a casing unit of the air conditioner adjacent a side surface of the casing unit, the mounting unit rotating to an abutting position against the side surface of the casing unit when the mounting unit is rotated.

BRIEF DESCRIPTION OF THE DRAWINGS

These and/or other aspects and advantages will become apparent and more readily appreciated from the following description of the embodiment, taken in conjunction with the accompanying drawings in which.

DETAILED DESCRIPTION OF EMBODIMENT

Figure 1:
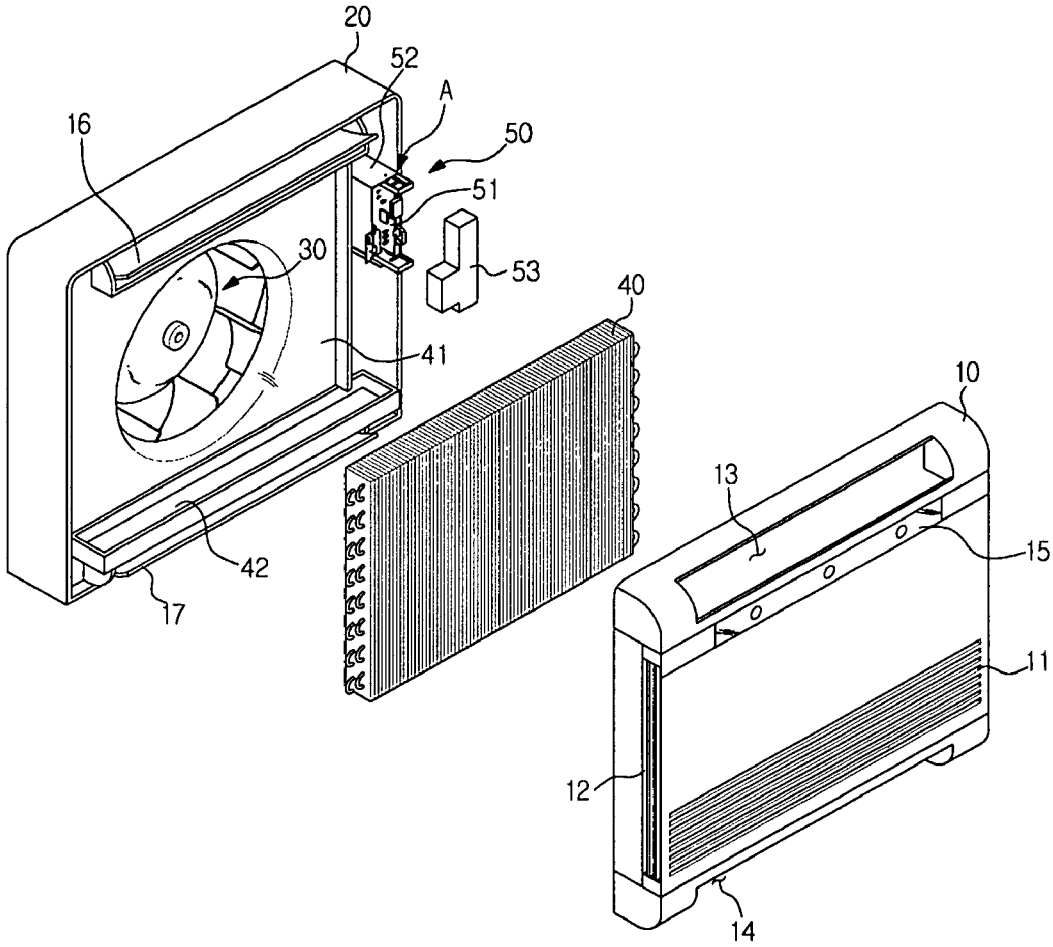
FIG. 1 is an exploded perspective view illustrating an external appearance of an air conditioner in accordance with an embodiment.

Reference will now be made in detail to the embodiment, an example of which is illustrated in the accompanying drawings, wherein like reference numerals refer to like elements throughout. The embodiment is described below to explain the present invention by referring to the annexed drawings.

Figure 2:
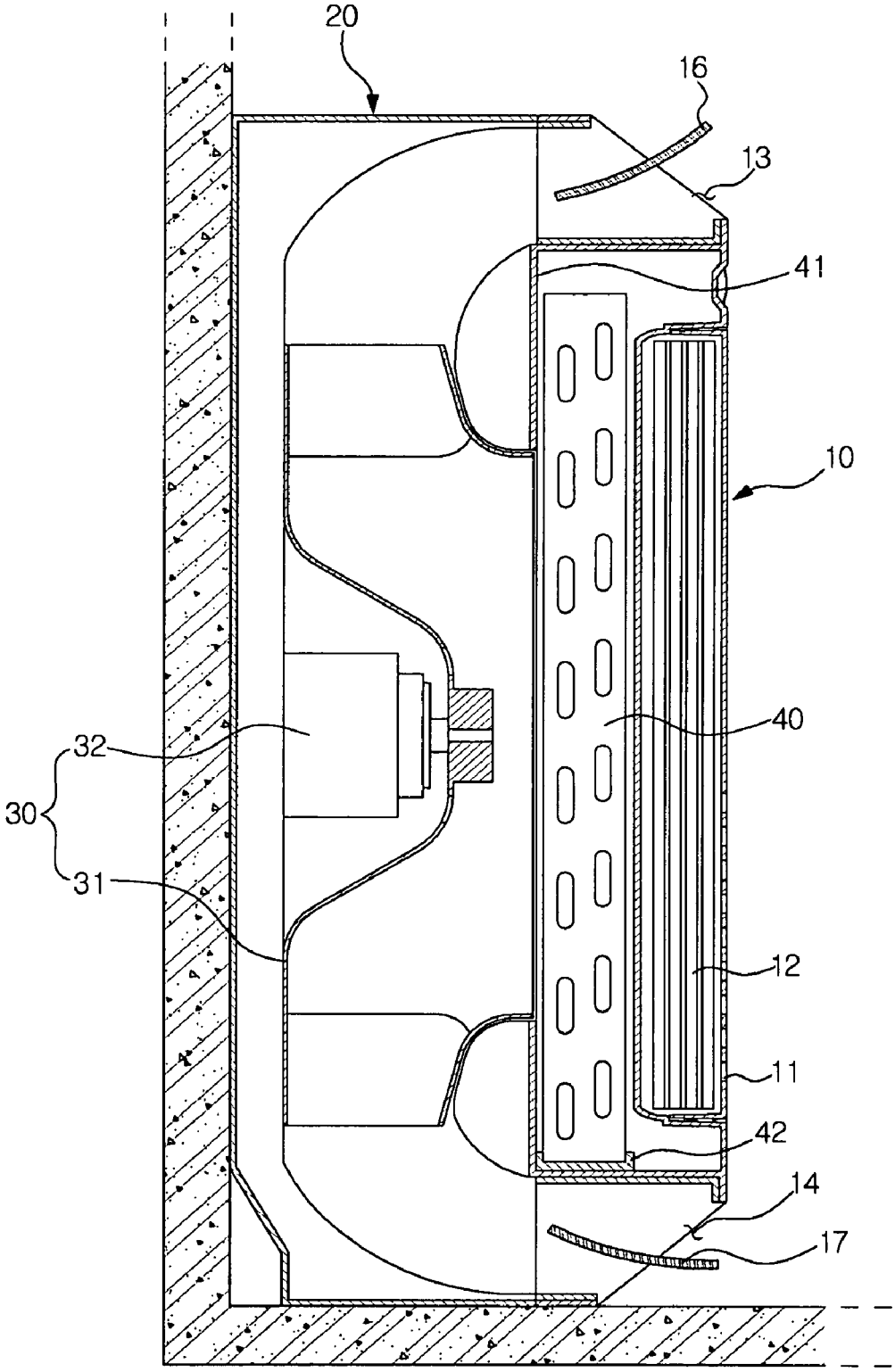
FIG. 2 is a cross-sectional view illustrating a constitution of the air conditioner in accordance with the embodiment.

FIG. 1 is an exploded perspective view illustrating an external appearance of an air conditioner in accordance with an embodiment, and FIG. 2 is a cross-sectional view illustrating the constitution of the air conditioner in accordance with the embodiment.

With reference to FIGS. 1 and 2, the air conditioner in accordance with the preferred embodiment of the present invention includes a casing unit 10 and 20 forming the external appearance of the air conditioner, and a blowing device 30, a heat exchanger 40, and a control box assembly 50, which are provided in the casing unit 10 and 20.

The casing unit 10 and 20 includes a front casing 10 forming a front surface of the air conditioner, and a rear casing 20 connected with the front casing 10 to form a space in which the heat exchanger 40, the blowing device 30, and the control box assembly 50 are disposed.

Front suction hole 11 and side suction holes 12 to suck air are formed through a lower portion of the front surface and side surfaces of the front casing 10, and an upper discharge hole 13 and a lower discharge hole 14, which are extended in a transversal direction, are formed through upper and lower portions of the front casing 10.

The above suction holes 11 and 12 and discharge holes 13 and 14 may be disposed in various shapes according to the design of the air conditioner.

A filter (not shown) to filter out foreign substances from air sucked through the suction holes 11 and 12 may be installed in each of the suction holes 11 and 12.

Blades 16 and 17 to open and close the discharge holes 13 and 14 and regulate the directions of air currents discharged from the discharge holes 13 and 14 are rotatably connected to the discharge holes 13 and 14.

The blades 16 and 17 are rotated to close the discharge holes 13 and 14 and thus prevent foreign substances, such as dust, from flowing into the air conditioner when the air conditioner is not operated, and are rotated to open the discharge holes 13 and 14 when the air conditioner is operated. Simultaneously, the blades 16 and 17 are rotated to regulate the directions of the air currents discharged from the discharge holes 13 and 14 according to a user's selection.

A display unit 15 displaying whether or not the air conditioner is operated and the operating state of the air conditioner is provided on the upper portion of the front surface of the front casing 10.

Buttons to allow a user to control the air conditioner by hand and a signal reception part to allow the user to control the air conditioner using a remote controller are provided on the display unit 15.

The rear casing 20 may have an approximately rectangular box shape, and is connected to the front casing 10 to form a space accommodating various components.

The blowing device 30 to discharge heat-exchanged air through the discharge holes 13 and 14 is provided at a central portion of an inside of the casing unit 10 and 20. The blowing device 30 includes a blower fan 31 installed in the rear casing 20, and a fan driving motor 32 to drive the blower fan 31.

The blower fan 31 may be a turbo fan, which sucks air in an axial direction and then discharges the air in a radial direction.

The heat exchanger 40, which exchanges heat with the sucked indoor air to generate cool air, is provided in front of the blower fan 31, and a bell mouth 41 to guide the flow of the heat-exchanged air is provided between the heat exchanger 40 and the blower fan 31.

A drain 42, which supports the heat exchanger 40 and collects water condensed by the heat exchanger 40, is provided at the lower portion in front of the bell mouth 41.

In the above-described air conditioner, a circuit board 51, which controls the blades 16 and 17 and the fan driving motor 32 or is electrically connected to the respective components to input and output signals to and out of the display unit 15, is provided at one side of the inside of the casing unit 10 and 20.

The air conditioner in accordance with the embodiment includes the control box assembly 50 including a control box 52 made of a metal and housing the circuit board 51 as provision for the fire or explosion of the circuit board 51.

With respect to the enhancement of space utilization in the casing unit 10 and 20, the circuit board 51 may be disposed perpendicularly to the rear surface of the rear casing 20.

In the case that the circuit board 51 is disposed perpendicularly, the workability in repairing and replacing the circuit board 51, which has malfunctioned, is lowered. In order to solve the above problem, the control box assembly includes a mounting unit, which is movable, and guide units guiding the mounting unit, and thus enhances the workability in repairing and replacing the circuit board. Hereinafter, the control box assembly including the mounting unit and guide units will be described concretely.

Figure 3:
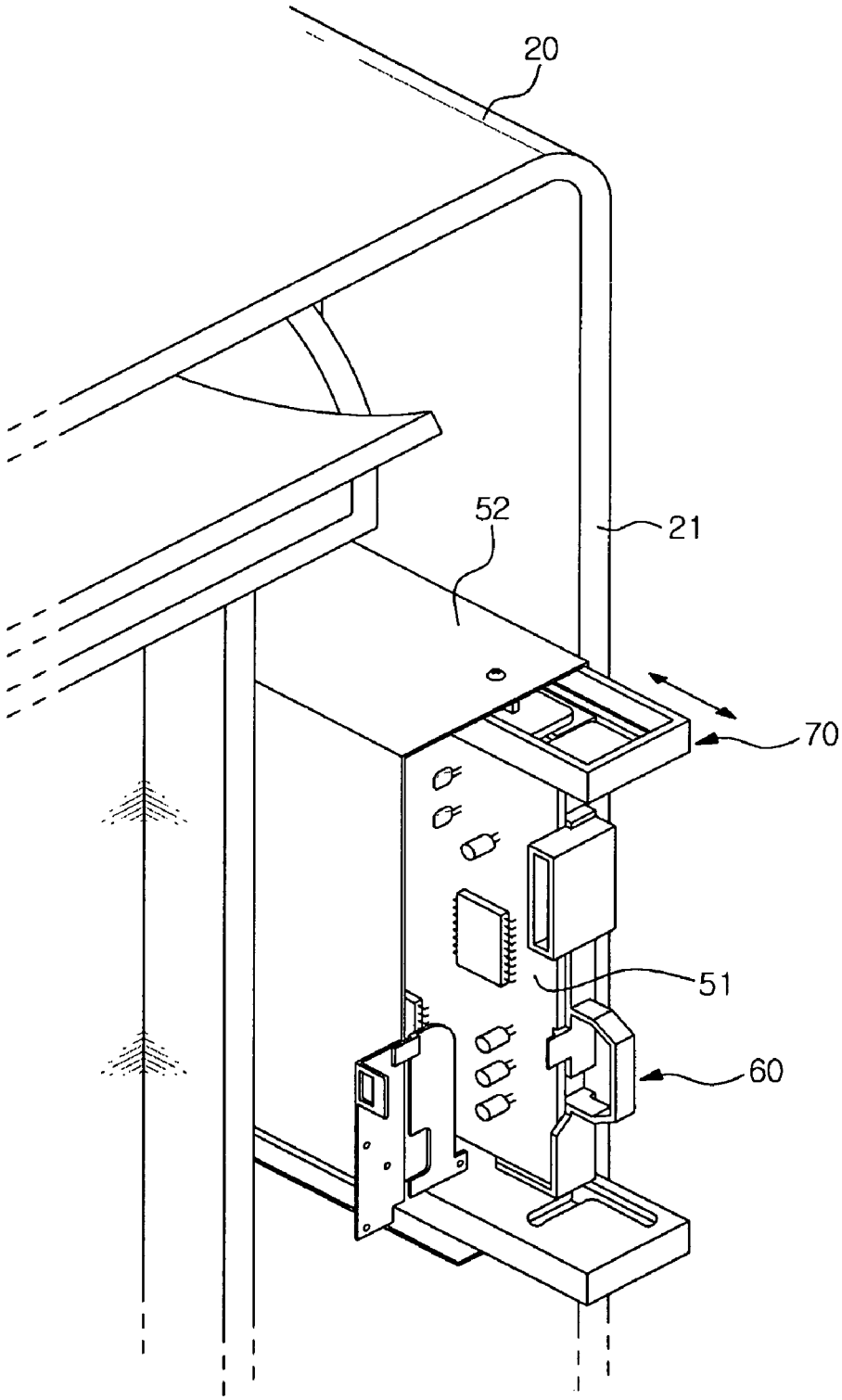
FIG. 3 is an enlarged view of the portion 'A' of FIG. 1.

FIG. 3 is an enlarged view of the portion 'A' of FIG. 1.

The control box assembly 50, as shown in FIGS. 1 and 3, includes the control box 52 forming a receipt space to receive the circuit board 51, a mounting unit 60 to mount the circuit board 51, guide units 70 to guide the rectilinear reciprocating motion of the mounting unit 60 to allow the circuit board 51 and the mounting unit 60 to come into and out of the control box 52 and guide the rotating motion of the mounting unit 60 to expose the circuit board 51 fixed to the mounting unit 60 in an outward direction of the rear casing 20 in the case that the mounting unit 60 is located at a designated position, and a cover 53 to open and close the control box 52.

Such a control box assembly 50 is provided at any one side of the inside of the casing unit 10 and 20. In the embodiment, the control box assembly 50 is installed close to an edge of the side surface 21 of the casing unit 10 and 20.

The control box 52 may be screw-connected to the rear casing 20, for example, may be made of a flame-retardant metal having a designated strength to minimize the influence of fire or an explosion of the circuit board 51 on the outside of the control box 52, and houses the circuit board 51 therein. Further, a wire passing part 52*a* (with reference to FIG. 4) to allow wires (not shown) connecting various components of the air conditioner and the circuit board 51 to enter the control box 52 is formed through one side surface of the control box 52.

The mounting unit 60 to mount the circuit board 51 thereon is configured such that the mounting unit 60 can come into and out of the control box 52 perpendicularly to the rear surface of the rear casing 20.

Figure 4:
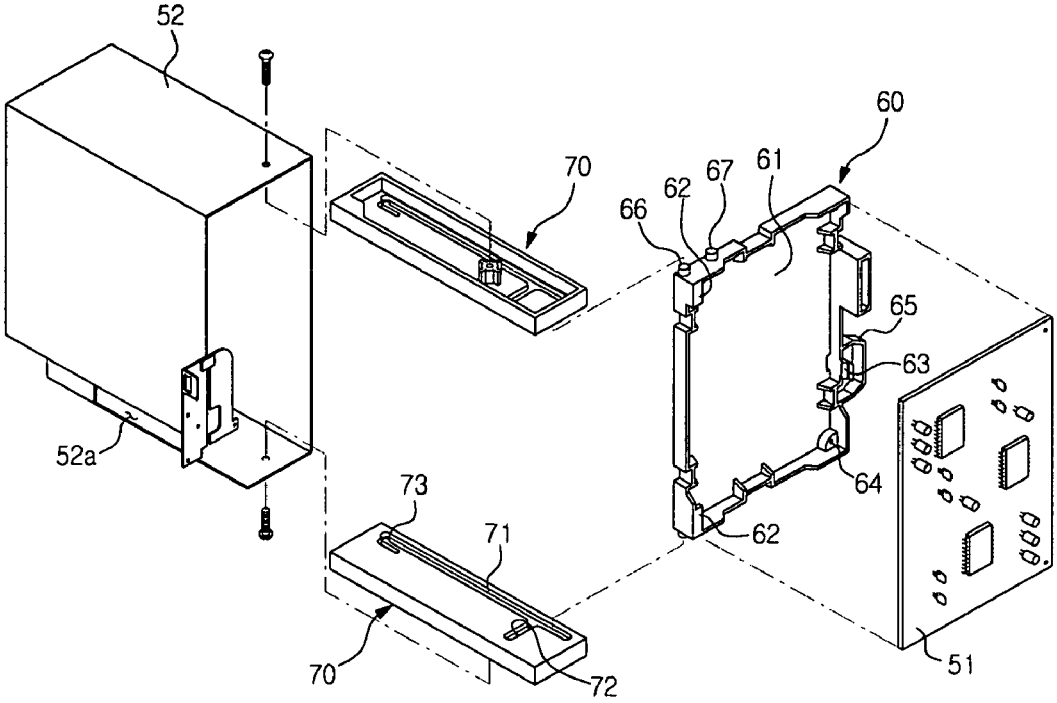
FIG. 4 is an exploded perspective view of a control box assembly of the air conditioner in accordance with the embodiment.
Figure 5:
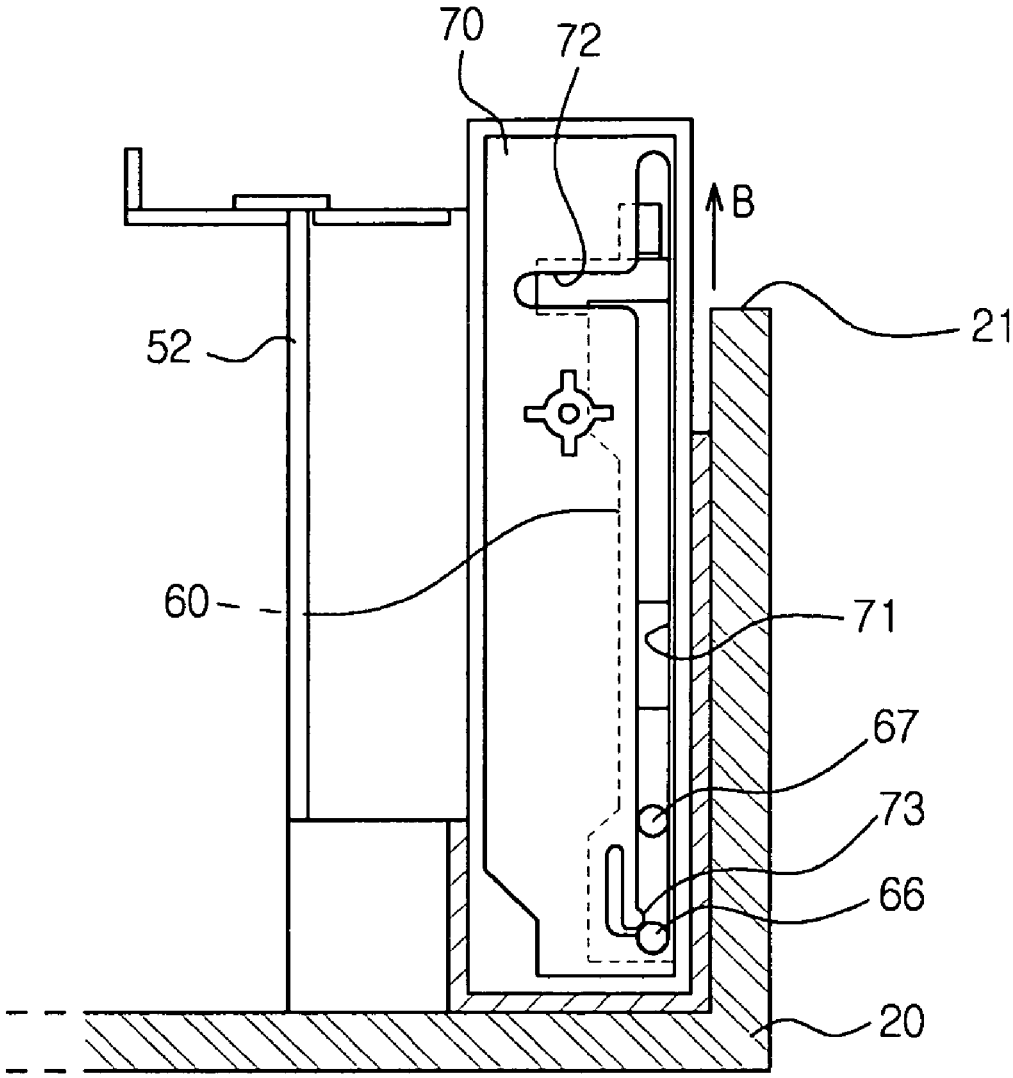
FIGS. 5, 6, and 7 are views illustrating the operation of the control box assembly or the air conditioner in accordance with the embodiment.
Figure 6:
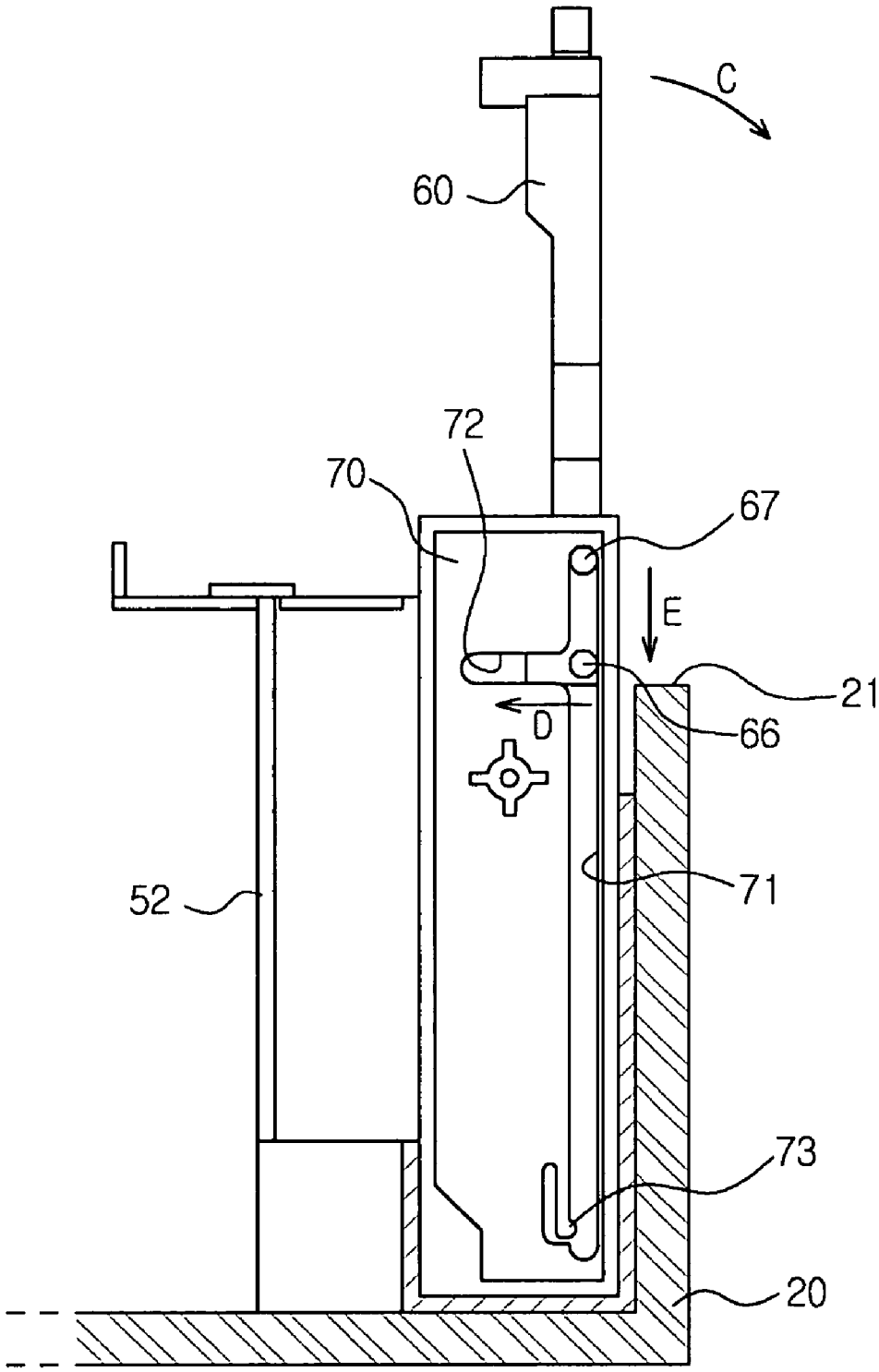
Figure 7:
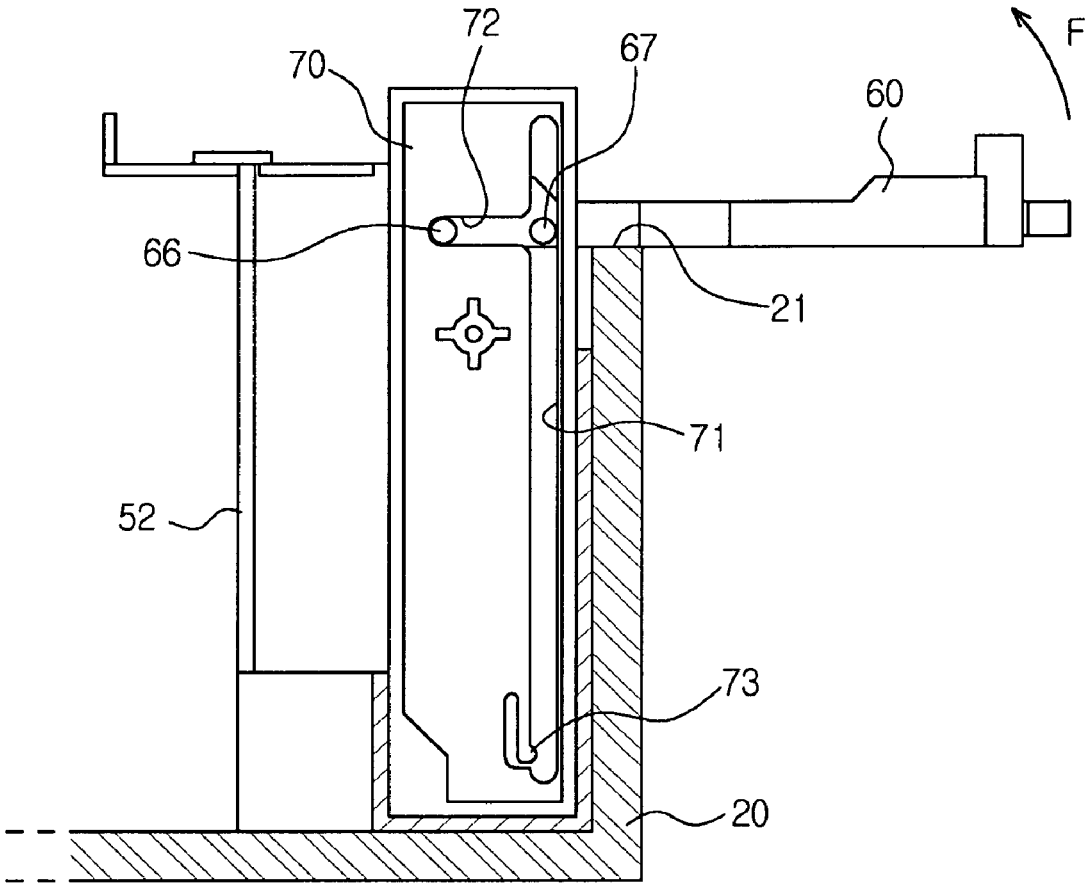

FIG. 4 is an exploded perspective view of the control box assembly of the air conditioner in accordance with the embodiment, and FIGS. 5, 6, and 7 are views illustrating the operation of the control box assembly or the air conditioner in accordance with the embodiment.

Although FIGS. 5, 6, and 7 do not illustrate a circuit board for the sake of convenience, in the case that the circuit board is mounted on the mounting unit, it is apparent that the control box assembly is operated in the same manner.

The edge of the mounting unit 60, as shown in FIG. 4, protrudes to form a mounting surface 61 on which the circuit board 51 is mounted. Further, the mounting unit 60 includes at least one insertion part 62, into which one side of the circuit board 51 is inserted to fix the circuit board 51, formed at the edge of the mounting surface 61, a hook part 63 to prevent the separation of the circuit board 51 from the mounting unit 60 when the circuit board 51 is mounted on the mounting surface 61, and a screw hole 64 to screw-connect the circuit board 51 to the mounting surface 61.

A handle 65 may be formed on the outer surface of the edge of the mounting unit 60 such that a user can grip the handle 65 to move the mounting unit 60.

A pair of guide protrusions 66 and 67 moving in guide slots 71 and 72 of the guide units 70, which will be described later, is formed on the outer surface of each of two opposite side surfaces of the mounting unit 60.

The pair of guide protrusions 66 and 67 includes a first guide protrusion 66 provided at an end of the mounting unit 60, and a second guide protrusion 67 separated from the first guide protrusion 66 by a designated interval.

The guide units 70, which form a pair, are provided in upper and lower portions of the control box 52, and serve to guide the motion of the mounting unit 60. Each of the guide units 70 includes a first guide slot 71, which is extended in the lengthwise direction of the guide unit 70 and guides the movement of the first and second guide protrusions 66 and 67 of the mounting unit 60 such that the mounting unit 60 can rectilinearly reciprocate, and a second guide slot 72, which is inclined from the first guide slot 71 at a designated angle and guides the movement of the first guide protrusion 66 during the rotating motion of the mounting unit 60.

The second guide slot 72 is extended perpendicularly from one side of the upper portion of the first guide slot 71 disposed in the lengthwise direction, and thus in the case that the first guide protrusion 66 slides along the second guide slot 72, the mounting unit 60 is rotated in an outward direction of the casing unit 10 and 20 (with reference to FIGS. 6 and 7).

When the mounting unit 60 is rotated as described above, the mounting surface 61 of the mounting unit 60 is exposed to the outside, as shown in FIG. 7. Thus, in the case that the circuit board 51 malfunctions, the repair and replacement of the circuit board 51 is smoothly carried out. Further, since the rear surface of the mounting unit 60 is supported by a front end 21 of the rear casing 20, when the circuit board 51 is replaced, it is possible to separate and connect a screw from and to the circuit board 51 and thus the workability is enhanced.

Further, a fixing part 73, to prevent the mounting unit 60 from being separated from the guide unit 70 in the case that the mounting unit 60 is accommodated in the control box 52, i.e., in the case that the first guide protrusions 66 of the mounting unit 60 are located at the lower ends of the first guide slots 71, is provided at the lower end of the first guide slot 71, as shown in FIG. 4.

The fixing part 73 is elastically deformed and allows the first guide protrusion 66 to enter thereinto when a user moves the mounting unit 60 downwardly, prevents the first guide protrusion 66 from being separated therefrom and fixes the mounting unit 60 to the inside of the control box 52 when external force is not applied, and allows the first guide protrusion 66 to be separated therefrom such that the mounting unit 60 can move upwardly when the user moves the mounting unit 60 upwardly.

The cover 53 opens and closes the opened upper portion of the control box 52. The cover 53 may be made of a material having the same property as that of the control box 52, and closes the upper portion of the control box 52 under the condition that the circuit board 51 is accommodated in the control box 52, thus minimizing the influence of the fire and explosion of the circuit board 51 on the outside of the control box 52 (with reference to FIG. 1).

Hereinafter, the operation of the control box assembly of the air conditioner in accordance with the embodiment will be described.

In the case that it is necessary to repair or replace the circuit board 51 due to the trouble of the circuit board 51, the front casing 10 is separated from the air conditioner, and then the cover 53 is separated from the control box assembly 53.

Thereafter, when a user pulls the mounting unit 60, on which the circuit board 51 disposed perpendicularly to the rear casing 20 is mounted, using the handle 65 in the forward direction (the direction 'B'), as shown in FIG. 5, the fixing parts 73 are elastically deformed. Thus, the first and second guide protrusions 66 and 67 move upwardly along the first guide slots 71. Thereby, the mounting part 60 is taken out of the control box 52 perpendicularly, as shown in FIG. 6.

Thereafter, when the user rotates the mounting unit 60 in the outward direction of the rear casing 20 (the direction 'C' of FIG. 6), the first guide protrusions 66 move in the direction 'D' along the second guide slots 72 and the second guide protrusions 67 move in the direction 'E' along the first guide slots 67, thereby allowing the mounting unit 60 to be rotated.

When the mounting unit 60 is rotated, the circuit board 51 fixed to the mounting surface 61 of the mounting unit 60 is exposed in the outward direction of the rear casing 20 and the rear surface of the mounting unit 60 is supported by the front end 21 of the rear casing 20, as shown in FIG. 7.

Therefore, wires, etc. are easily attached to and detached from the circuit board 51 during repairing and replacing the circuit board 51. Further, since the rear surface of the mounting unit 60 is supported by the front end 21 of the rear casing 20, the separation and connection of a screw is possible without any separate operation during replacing the circuit board 51 and thus the workability is enhanced.

After the circuit board 51 is repaired and replaced, the mounting unit 60 is rotated in the direction 'F' of FIG. 7 in opposite to the above operation, and is returned to the state of FIG. 6. When the mounting unit 60 is guided by the guide unit 70 and thus moves downwardly, the mounting unit 60 on which the circuit board 51 is mounted is easily inserted into the control box 52, as shown in FIG. 5.

As apparent from the above description, the present embodiment provides an air conditioner having a control box assembly, which includes a mounting unit to mount the circuit board and guide units to guide the rectilinear reciprocating motion of the mounting unit to allow the mounting unit to come into and out of a control box and guide the rotating motion of the mounting unit in the case that the mounting unit is located at a designated position, thus enhancing the serviceability of the circuit board and reducing the production costs of the control box assembly.

Although an embodiment has been shown and described, it would be appreciated by those skilled in the art that changes may be made in this embodiment without departing from the principles and spirit of the invention, the scope of which is defined in the claims and their equivalents.

What is claimed is:

1. An air conditioner, comprising:

a casing unit forming an external appearance of the air conditioner;

a heat exchanger;

a blowing device; and a control box assembly provided in the casing unit including a mounting unit mounting a circuit board, a control box housing the circuit board and the mounting unit, and guide units provided in the control box to guide a rectilinear reciprocating motion of the mounting unit to allow the mounting unit to come into and out of the control box and guide a rotating motion of the mounting unit when the mounting unit is located at a designated position.

2. The air conditioner according to claim 1, wherein each of the guide units includes a first guide slot guiding the rectilinear reciprocating motion of the mounting unit, and a second guide slot inclined from the first guide slot at a designated angle guiding the rotating motion of the mounting unit.

3. The air conditioner according to claim 1, wherein each of the guide units includes a fixing part to fix the mounting unit when the mounting unit is inserted into the control box.

4. The air conditioner according to claim 1, wherein the casing unit includes a front casing and a rear casing, a rear surface of the mounting unit being supported by a front end of the rear casing when the mounting unit is rotated.

5. The air conditioner according to claim 1, wherein the mounting unit is disposed to slide perpendicularly to a rear surface of the casing unit and is rotated in an outward direction of the casing unit when the mounting unit is located at a designated position protruding from the control box.

6. The air conditioner according to claim 1, wherein one side of the circuit board is connected to the mounting unit by insertion and another side of the circuit board is fixed to the mounting unit by screw connection.

7. An air conditioner, comprising:

a control box assembly including a mounting unit mounting a circuit board, and guide units supporting the mounting unit and guiding a sliding motion and a rotating motion of the mounting unit.

8. A control box assembly for an air conditioner having a circuit board, the control box assembly comprising:

a control box to receive the circuit board;

a mounting unit mounting the circuit board and being received within the control box; and guide units affixed within the control box and receiving the mounting unit, the mounting unit being rectilinearly reciprocated along the guide units when the mounting unit is removed from within the control box and being rotated with respect to the direction of the rectilinear reciprocating motion.

9. The control box assembly according to claim 8, wherein the mounting unit is rotated to a position substantially perpendicular to a position at which the mounting unit is removed from the control box.

10. The control box assembly according to claim 8, wherein the mounting unit includes a plurality of guide protrusions.

11. The control box assembly according to claim 10, wherein the guide units each include a first guide slot along a length of the guide unit and a second guide slot substantially at an end of the guide unit, the first guide slot receiving the guide protrusions, the second guide slot capable of receiving at least one of the guide protrusions.

12. The control box assembly according to claim 11, wherein the second guide slot is substantially perpendicular with respect to the first guide slot.

13. The control box assembly according to claim 11, further comprising a fixing unit disposed at an end of the first guide slot opposite the second guide slot, the fixing unit receiving at least one of the guide protrusions to fix the mounting unit to the control box.

14. The control box assembly according to claim 11, wherein the control box assembly is provided within a casing unit of the air conditioner adjacent a side surface of the casing unit, the mounting unit rotating to an abutting position against the side surface of the casing unit when the mounting unit is rotated.

* * * * *